US009326552B2

(12) United States Patent
Hays et al.

(10) Patent No.: US 9,326,552 B2
(45) Date of Patent: May 3, 2016

(54) ABDOMINAL-RESTRAINT GARMENT AND METHODS OF ASSEMBLING THE SAME

(71) Applicant: Spanx, Inc., Atlanta, GA (US)

(72) Inventors: Tosha L. Hays, Atlanta, GA (US); Laurie A. Goldman, Atlanta, GA (US)

(73) Assignee: Spanx, Inc., Atlanta, GA (US)

( * ) Notice: Subject to any disclaimer, the term of this patent is extended or adjusted under 35 U.S.C. 154(b) by 397 days.

(21) Appl. No.: 13/835,175

(22) Filed: Mar. 15, 2013

(65) Prior Publication Data

US 2014/0273743 A1 Sep. 18, 2014

(51) Int. Cl.
*A41B 9/08* (2006.01)
*A41C 1/08* (2006.01)

(52) U.S. Cl.
CPC .... *A41C 1/08* (2013.01); *A41B 9/08* (2013.01)

(58) Field of Classification Search
CPC ..... A41D 13/00; A41D 1/00; A41D 9/00
USPC ..... 2/227, 228, 236, 237, 69, 79, 400, 403
See application file for complete search history.

(56) References Cited

U.S. PATENT DOCUMENTS

| | | | | | |
|---|---|---|---|---|---|
| 2,410,226 | A | | 10/1946 | Martin | |
| 3,127,896 | A | * | 4/1964 | Puliafico | 450/95 |
| 3,234,947 | A | * | 2/1966 | Bergstein | 450/95 |
| 3,246,342 | A | * | 4/1966 | Pagano | 2/227 |
| 3,457,926 | A | | 7/1969 | Louis et al. | |
| 4,069,513 | A | * | 1/1978 | Shiller et al. | 2/227 |
| 5,535,451 | A | * | 7/1996 | Tassone et al. | 2/227 |
| 5,675,842 | A | * | 10/1997 | Schaefer | 2/237 |
| 6,035,448 | A | * | 3/2000 | Thomson | 2/227 |
| 6,138,282 | A | * | 10/2000 | Follese | 2/400 |
| 6,205,591 | B1 | * | 3/2001 | Wheeler et al. | 2/227 |
| 6,311,333 | B1 | * | 11/2001 | Batra | 2/237 |

(Continued)

FOREIGN PATENT DOCUMENTS

| | | |
|---|---|---|
| EP | 2401930 | 1/2012 |
| EP | 20110165865 | 1/2012 |
| GB | 2356552 | 5/2001 |

OTHER PUBLICATIONS

U.S. Appl. No. 13/834,506, filed Mar. 15, 2013, and the prosecution history thereof.

(Continued)

*Primary Examiner* — Gloria Hale
(74) *Attorney, Agent, or Firm* — Meunier Carlin & Curfman LLC

(57) ABSTRACT

Disclosed herein are abdominal-restraint garments comprising an outer garment layer and an inner abdominal-restraint layer. The inner abdominal-restraint layer can be attached to the outer garment layer. In some embodiments, a front bottom and/or back bottom of the inner abdominal-restraint layer are attached to an inner side of the outer garment layer. The front top of the inner abdominal-restraint layer can be configured to be even with the front rise of the outer garment layer or extend above the front rise of the outer garment layer. The inner abdominal-restraint layer can be configured to extend across a garment-wearer's abdominal region. In some embodiments, the abdominal-restraint garment is a pair of pants, jeans, a pair of shorts, a skirt, leggings, or tights. Also disclosed herein are methods of assembling the abdominal-restraint garments disclosed herein.

29 Claims, 4 Drawing Sheets

(56) References Cited

U.S. PATENT DOCUMENTS

| | | | | |
|---|---|---|---|---|
| 6,543,062 | B1 * | 4/2003 | Amsel et al. | 2/227 |
| D588,782 | S | 3/2009 | Rudes | |
| 7,596,816 | B1 | 10/2009 | Henry et al. | |
| D644,412 | S | 9/2011 | Reuther | |
| 8,418,268 | B2 | 4/2013 | Waldman et al. | |
| 8,959,665 | B1 * | 2/2015 | Garner et al. | 2/237 |
| 2004/0163159 | A1 | 8/2004 | Edwards et al. | |
| 2007/0118954 | A1 * | 5/2007 | Lee | 2/69 |
| 2007/0136930 | A1 | 6/2007 | Dipietro | |
| 2007/0266478 | A1 * | 11/2007 | Girod | 2/227 |
| 2008/0295225 | A1 | 12/2008 | Hendrickson et al. | |
| 2009/0031470 | A1 | 2/2009 | Ishikawa et al. | |
| 2010/0136882 | A1 | 6/2010 | Malish | |
| 2011/0004976 | A1 | 1/2011 | MacGillivray | |
| 2011/0059678 | A1 | 3/2011 | Agassi et al. | |
| 2011/0099677 | A1 | 5/2011 | Mayime et al. | |
| 2011/0131705 | A1 | 6/2011 | Waldman et al. | |

OTHER PUBLICATIONS

U.S. Appl. No. 14/533,538, filed Nov. 5, 2014 and the prosecution history thereof.

* cited by examiner

Figure 1: An embodiment of an Abdominal-Restraint Garment, front-view
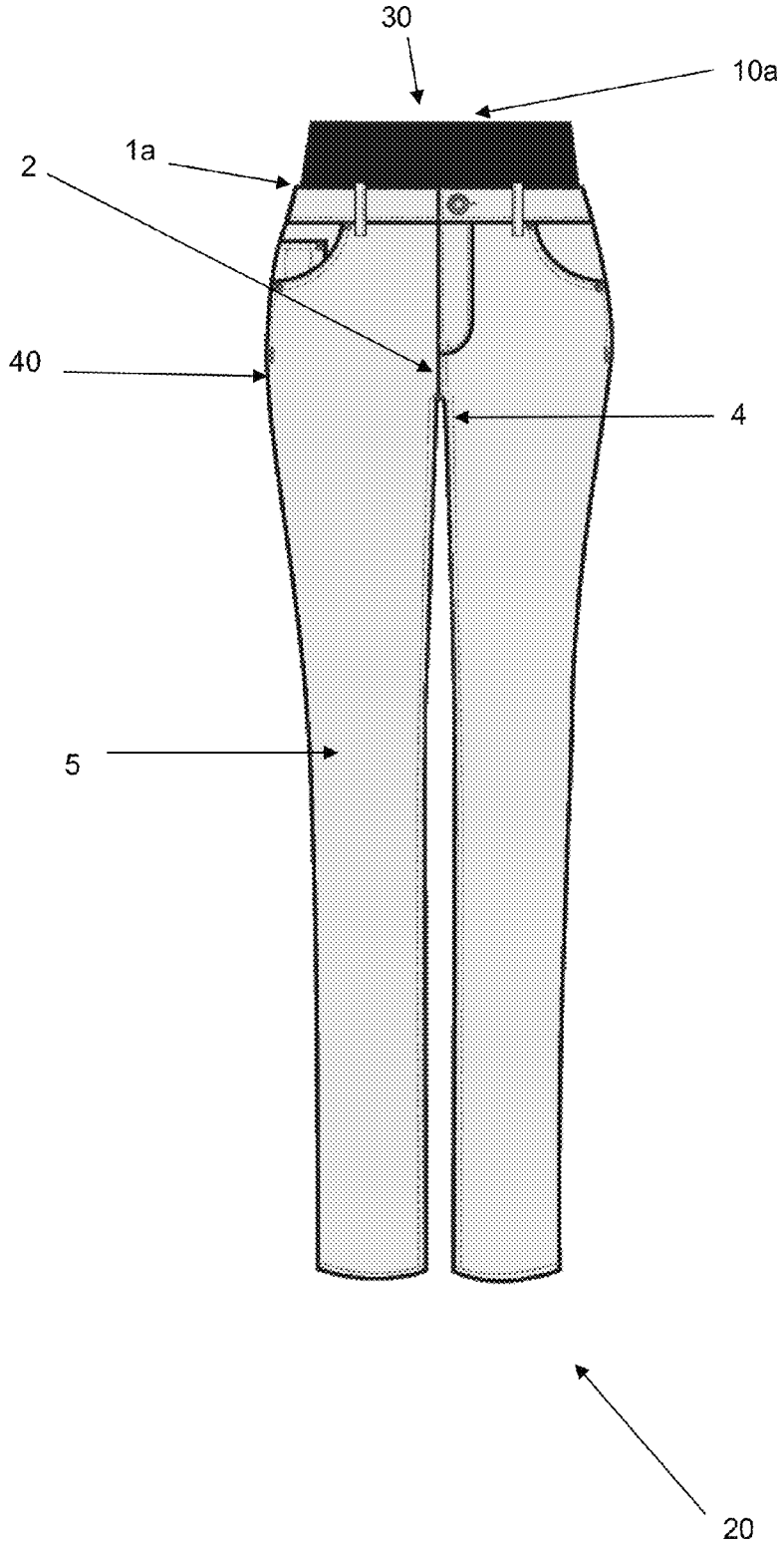

Figure 2. An embodiment of an Abdominal-Restraint Garment, back-view
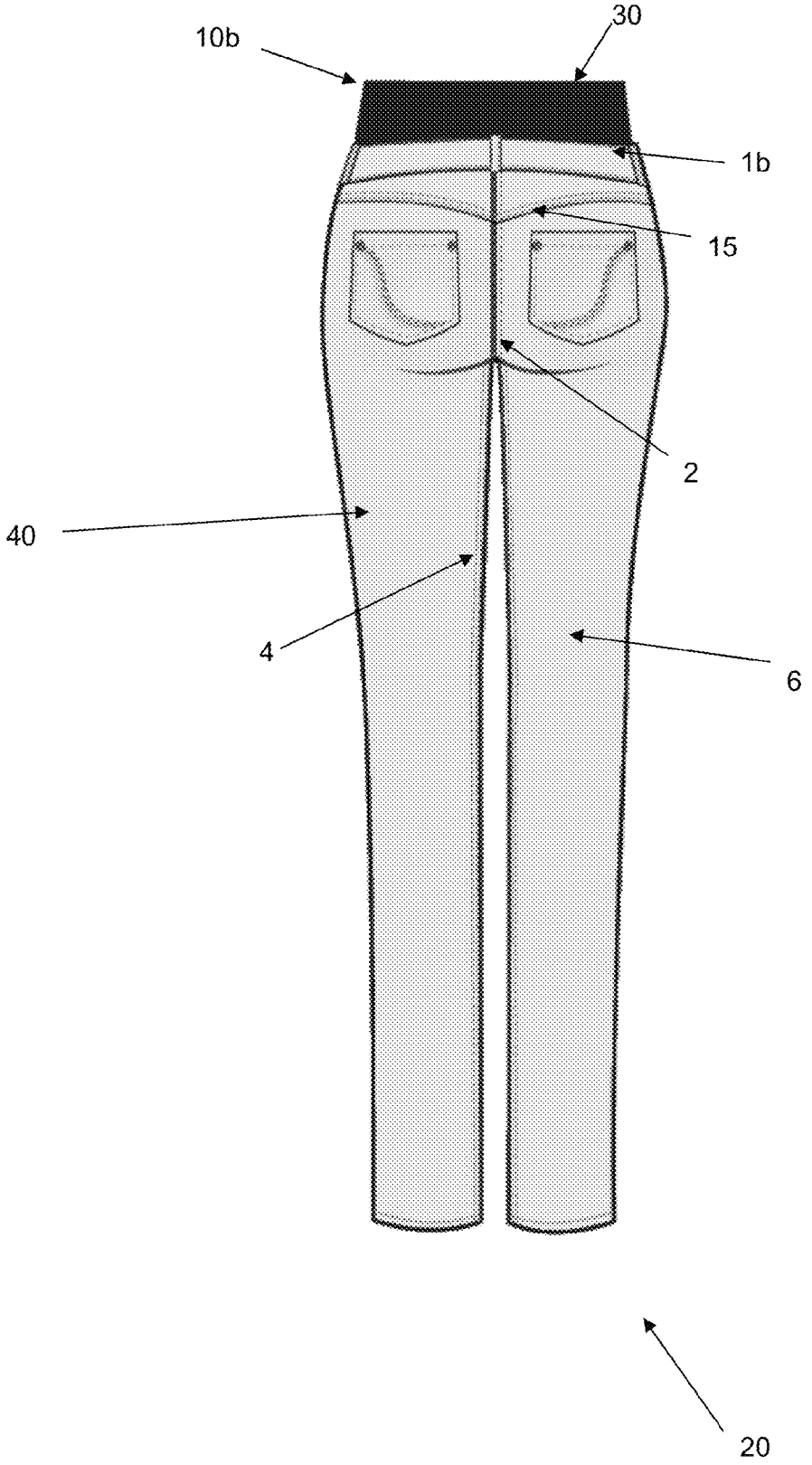

Figure 3. One embodiment of the Inner Abdominal-Restraint Layer, front-view
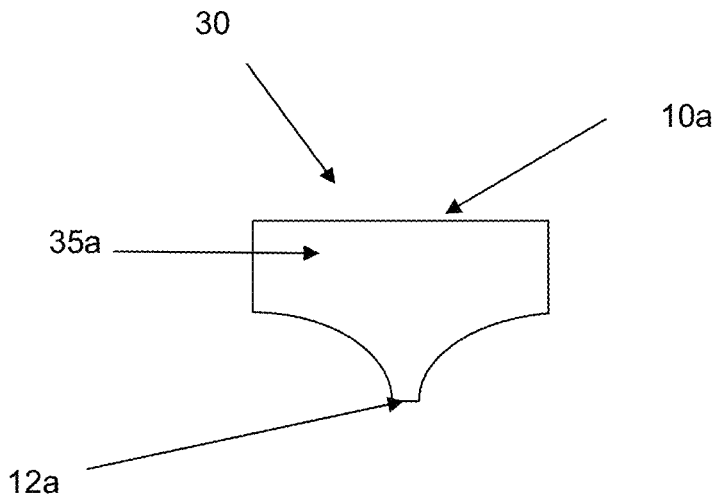

Figure 4. One embodiment of the Inner Abdominal-Restraint Layer, back-view
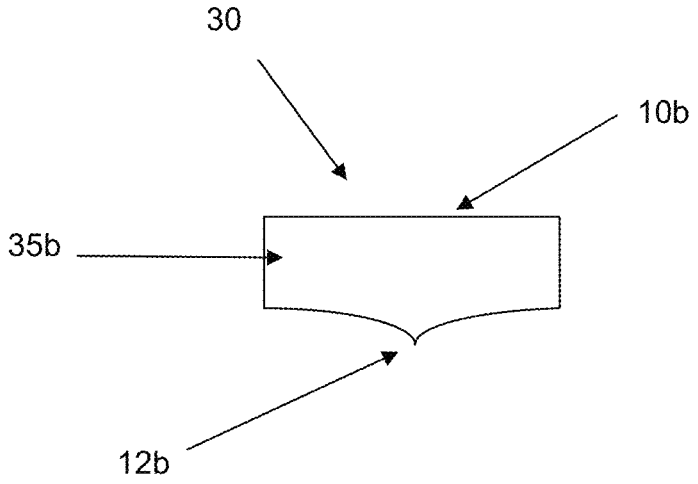

ABDOMINAL-RESTRAINT GARMENT AND METHODS OF ASSEMBLING THE SAME

FIELD OF THE DISCLOSURE

The present disclosure relates to abdominal restraint garments comprising an outer garment layer and an inner abdominal-restraint layer. The present disclosure also relates to methods of assembling the abdominal restraint garments disclosed herein.

BACKGROUND

Many people face recurring problems with abdominal fat protruding over and around their clothing, especially with lower-body garments that cinch at the waist. Designers have produced a variety of garments and undergarments designed to help conceal undesirable bulges of abdominal fat caused by garments that cinch at the waist (known as the "muffin top" effect). However, a continuing need exists for improved garments and undergarments that can restrain, smooth, and conceal undesirable bulges of abdominal fat.

SUMMARY OF THE DISCLOSURE

Disclosed herein are abdominal-restraint garments comprising an outer garment layer and an inner abdominal-restraint layer. The outer garment layer can comprise a front rise, a back rise, an inseam, a crotch seam, an anterior portion, a posterior portion, a yoke, or combinations thereof. The inner abdominal-restraint layer can have a front portion having a front top and a front bottom, and a back portion having a back top and a back bottom, or combinations thereof.

The inner abdominal-restraint layer can be attached to the outer garment layer (for instance, by sewing, adhering, zipping, buttoning, snapping, heat sealing, welding, gluing, bonding, laser cutting, and combinations thereof). In some embodiments, the front bottom of the inner abdominal-restraint layer and back bottom of the inner-abdominal restraint layer are attached to an inner side of the outer garment layer. In some embodiments, the front bottom of the inner abdominal-restraint layer is attached to the inner side of the inseam of the outer garment layer, to the inner side of the crotch seam of the outer garment layer, or to a combination thereof. In some embodiments, the back bottom of the inner abdominal-restraint layer is attached to the inner side of the yoke of the outer garment layer.

The front top of the inner abdominal-restraint layer can be configured to be even with the front rise of the outer garment layer or extend above the front rise of the outer garment layer by, for instance, 0.25 inches to 20 inches. The back top of the inner abdominal-restraint layer can be configured to be even with the back rise of the outer garment layer or extend above the back rise of the outer garment layer by, for instance, 0.25 inches to 20 inches. The inner abdominal-restraint layer can be configured to extend across a garment-wearer's abdominal region.

In some embodiments, the abdominal-restraint garment is a pair of pants, jeans, a pair of shorts, a skirt, leggings, or tights. In some embodiments, the inner abdominal-restraint layer has a higher elasticity than the outer garment layer. The outer garment layer can comprise denim, twill, woven fabric, or knit fabric. The inner abdominal-restraint layer can comprise spandex or a spandex blend.

Also disclosed herein are methods of assembling abdominal-restraint garments, comprising attaching a front bottom of an inner abdominal-restraint layer to an inner side of an outer garment layer, positioning the inner abdominal-restraint layer over an abdominal portion of the outer garment layer, positioning a front top of the inner abdominal-restraint layer such that it is even with a front rise of the outer garment layer or such that it extends above a front rise of the outer garment layer, positioning a back top of the inner abdominal-restraint layer such that it is even with a back rise of the outer garment layer or such that it extends above a back rise of the outer garment layer, and attaching a back bottom of the inner abdominal-restraint layer to the inner side of the outer garment layer.

The description below sets forth details of one or more embodiments of the present disclosure. Other features, objects, and advantages will be apparent from the description and from the claims.

BRIEF DESCRIPTION OF THE FIGURES

FIG. 1 depicts a front-view of one embodiment of an abdominal-restraint garment disclosed herein.

FIG. 2 depicts a back-view of one embodiment of an abdominal-restraint garment disclosed herein.

FIG. 3 depicts a front-view of one embodiment of an inner abdominal-restraint layer disclosed herein.

FIG. 4 depicts a back-view of one embodiment of an inner abdominal-restraint layer disclosed herein.

DETAILED DESCRIPTION

Disclosed herein are abdominal-restraint garments comprising an inner abdominal-restraint layer attached to an outer garment layer, and methods of assembling the same.

The abdominal-restraint garments disclosed herein can be any lower-body garment wherein restraining, smoothing, or concealing bulges of abdominal fat caused by cinching the garment wearer's waist could be desirable. In some embodiments, the abdominal-restraint garment is a pair of pants, jeans, a pair of shorts, a skirt, leggings, or tights. FIGS. 1-4 depict exemplary embodiments of the abdominal-restraint garments described herein.

As depicted in FIGS. 1 and 2, the abdominal-restraint garments 20 disclosed herein comprise an outer garment layer 40 and an inner abdominal-restraint layer 30. The front bottom 12*a* and back bottom 12*b* of the inner abdominal-restraint layer 30 attach to the inside of the outer garment layer 40, forming a convenient one-piece abdominal-restraint garment 20 that reduces or eliminates the undesirable muffin-top effect to the garment wearer without the need for wearing a separate shape-wear piece (e.g., pantyhose, control-top underwear, etc.) and outer wear piece (e.g., pants, jeans, skirts, leggings, etc.). Additionally, the convenient one-piece abdominal-restraint garment 20 can be easier for the garment wearer to put on and take off than separate shape-wear pieces and outer-wear pieces (e.g., while dressing for the day or during bathroom breaks during the day). The top of the inner abdominal-restraint layer 30 is even with or projects above the front rise 1*a* and back rise 1*b* of the outer garment layer 40 to restrain, conceal, or smooth undesirable bulges of abdominal fat and reduce or eliminate the muffin-top effect. The top of the inner abdominal-restraint layer 30 can be configured to extend above the front rise 1*a* and back rise 1*b* of the outer garment layer 40 by various amounts, depending on the degree of abdominal coverage desired.

The outer garment layer can comprise any fabric known in the art for use in a lower-body garment. The outer garment layer can comprise a natural fabric, a synthetic fabric, or a blended fabric. In some embodiments, the outer garment layer comprises denim, twill, woven fabric, or knit fabric. Exemplary outer garment layers can comprise, for example, cotton, leather, faux leather, suede, faux suede, polyester, denim, twill, tweed, wood pulp, bamboo, corn fibers, leaves, moleskin, barkcloth, barathea, silk, rayon, nylon, wool, batiste, Bedford cord, bengaline, acetate, berber fleece, burlap, flannel, canvas, lace, goat skin, satin, sateen, charmeuse, cheesecloth, corduroy, linen, crinoline, velvet, spandex, animal pelts, faux animal pelts, jersey, terry cloth, velour, velveteen, nonwoven fabrics such as felt, and blends thereof. The outer garment layer can comprise any number of layers of fabric. In some embodiments, the outer garment layer comprises one layer. In some embodiments, the outer garment layer comprises two layers. The outer garment layer can comprise, for instance, a bonded fabric comprising two or more layers joined together with, for instance, an adhesive, resin, foam, fusible membrane, or sewn together. As shown in FIGS. 1 and 2, the outer garment layer 40 can comprise a front rise 1*a*, a back rise 1*b*, an inseam 4, a crotch seam 2, an anterior portion 5, a posterior portion 6, a yoke 15, or combinations thereof.

The inner abdominal-restraint layer can be made of any fabric capable of restraining, smoothing, and/or concealing undesirable bulges of abdominal fat. In some embodiments, the inner abdominal-restraint layer has a higher elasticity than the outer garment layer. The inner abdominal-restraint layer can comprise a natural fabric, a synthetic fabric, or a blend thereof. In some embodiments, the inner abdominal-restraint layer comprises spandex. In some embodiments, the inner abdominal-restraint layer comprises a spandex blend. In some embodiments, the inner abdominal-restraint layer comprises a polyester/spandex blend. In some embodiments, the inner abdominal-restraint layer comprises nylon. In some embodiments, the inner abdominal-restraint layer comprises 75% or less of spandex (e.g., 70% or less, 60% or less, 50% or less, 40% or less, 35% or less, 30% or less, 25% or less, 20% or less, 15% or less, or 10% or less). In some embodiments, the inner abdominal-restraint layer comprises 5% or greater of spandex (e.g., 10% or greater, 15% or greater, 20% or greater, 25% or greater, 30% or greater, 35% or greater, 40% or greater, 50% or greater, or 60% or greater). In some embodiments, the inner abdominal-restraint layer comprises 90% or less of nylon (e.g., 85% or less, 80% or less, 75% or less, 70% or less, 60% or less, 50% or less, 40% or less, 35% or less, 30% or less, 25% or less, 20% or less, 15% or less, or 10% or less). In some embodiments, the inner abdominal-restraint layer comprises 5% or greater of nylon (e.g., 10% or greater, 15% or greater, 20% or greater, 25% or greater, 30% or greater, 35% or greater, 40% or greater, 50% or greater, 60% or greater, 65% or greater, 70% or greater, 75% or greater, 80% or greater, or 85% or greater). In some embodiments, the inner abdominal-restraint layer comprises 40% or less of polyester (e.g., 30% or less, 25% or less, 20% or less, 15% or less, or 10% or less). In some embodiments, the inner abdominal-restraint layer comprises 5% or greater of polyester (e.g., 10% or greater, 15% or greater, 20% or greater, 25% or greater, 30% or greater, or 35% or greater). In some embodiments, the inner abdominal-restraint layer comprises a spandex/nylon blend. In some embodiments, the inner abdominal-restraint layer comprises modal, rayon, and spandex. In some embodiments, the inner abdominal-restraint layer comprises cotton. In some embodiments, the inner abdominal-restraint layer comprises a cotton blend. In some embodiments, the inner abdominal-restraint layer comprises cotton. The inner abdominal-restraint layer can be chosen from any of the fabrics described above for the outer garment layer. The inner abdominal-restraint layer can be made, for instance, by circular knitting, warp knitting, or any weaving or knitting technique known in the art. In some embodiments, the inner-abdominal restraint layer has varied properties. For instance, the inner abdominal-restraint layer can have a gradient of elasticity, horizontally or vertically across the inner abdominal-restraint layer. In some embodiments, the inner abdominal-restraint layer comprises a denser fabric at the bottom. In some embodiments, the inner abdominal-restraint layer comprises a less dense fabric at the top.

The inner abdominal-restraint layer can comprise any number of layers of fabric. In some embodiments, the inner abdominal-restraint layer comprises one layer. In some embodiments, the inner abdominal-restraint layer comprises two layers. The inner abdominal-restraint layer can comprise, for instance, a bonded fabric comprising two or more layers joined together with, for instance, an adhesive, resin, foam, or fusible membrane. In some embodiments, the inner abdominal-restraint layer comprises a double layer with sandwiched elastic at the waist. In some embodiments, the inner abdominal-restraint layer comprises a single layer with no elastic. As depicted in FIGS. 3 and 4, the inner abdominal-restraint layer 30 can have a front portion 35*a* having a front top 10*a* and a front bottom 12*a*, and a back portion having a back top 10*b* and a back bottom 12*b*, or combinations thereof.

The inner abdominal-restraint layer can be attached to the outer garment layer by any means capable of attaching garment layers together. In some embodiments, the outer garment layer is attached by sewing, adhering, zipping, buttoning, snapping, heat sealing, welding, gluing, bonding, laser cutting, and combinations thereof. In some embodiments, the first lateral edge and the second lateral edge of the inner abdominal-restraint layer are attached to an inner side of the outer garment layer. In some embodiments, the first lateral edge of the inner abdominal-restraint layer is attached to the inner side of the first side seam of the outer garment layer, and the second lateral edge of the inner abdominal-restraint layer is attached to inner side of the second side seam of the outer garment layer.

The front bottom 12*a* of the inner abdominal-restraint garment can be attached to the outer garment layer or not attached to the outer garment layer. In some embodiments, the front bottom 12*a* of the inner abdominal-restraint layer 30 is attached to the inner side of the inseam 4 of the outer garment layer 40, to the inner side of the crotch seam 2 of the outer garment layer 40, or to a combination thereof. The back bottom 12*b* of the inner abdominal-restraint garment can be attached to the outer garment layer or not attached to the outer garment layer. In some embodiments, the back bottom 12*b* of the inner abdominal-restraint layer 30 is attached to the inner side of posterior portion 6 of the outer garment layer 40. In some embodiments, back bottom 12*b* of the inner abdominal-restraint layer 30 is attached on or adjacent to the inner side of the yoke 15 of the outer garment layer 40.

The front top of the inner abdominal-restraint layer can be configured to be even with the front rise of the outer garment layer or extend above the front rise of the outer garment layer by, for instance, 0.25 inches to 20 inches (e.g., 0.5 inches, 1 inch, 1.5 inches, 2 inches, 2.5 inches, 3 inches, 3.5 inches, 4 inches, 4.5 inches, 5 inches, 5.5 inches, 6 inches, 6.5 inches, 7 inches, 7.5 inches, 8 inches, 8.5 inches, 9 inches, 9.5 inches, 10 inches, 10.5 inches, 11 inches, 11.5 inches, 12 inches, 12.5 inches, 13 inches, 13.5 inches, 14 inches, 14.5 inches, 15 inches, 15.5 inches, 16 inches, 16.5 inches, 17 inches, 17.5 inches, 18 inches, 18.5 inches, 19 inches, 19.5 inches). The back top of the inner abdominal-restraint layer can be configured to be even with the back rise of the outer garment layer or extend above the back rise of the outer garment layer by, for instance, 0.25 inches to 20 inches (e.g., 0.5 inches, 1 inch, 1.5 inches, 2 inches, 2.5 inches, 3 inches, 3.5 inches, 4 inches, 4.5 inches, 5 inches, 5.5 inches, 6 inches, 6.5 inches, 7 inches, 7.5 inches, 8 inches, 8.5 inches, 9 inches, 9.5 inches, 10 inches, 10.5 inches, 11 inches, 11.5 inches, 12 inches, 12.5 inches, 13 inches, 13.5 inches, 14 inches, 14.5 inches, 15 inches, 15.5 inches, 16 inches, 16.5 inches, 17 inches, 17.5 inches, 18 inches, 18.5 inches, 19 inches, 19.5 inches). The inner abdominal-restraint layer can be configured to extend across a garment-wearer's abdominal region to a greater or lesser amount, depending on the amount of abdominal coverage desired by the garment wearer. The higher that the top of the inner abdominal-restraint layer extends above the front rise of the outer garment layer, the more of the garment-wearer's abdominal region can be covered by the inner abdominal-restraint layer. And in embodiments where more of the garment-wearer's abdominal region can be covered by the inner abdominal-restraint layer, greater smoothing, restraining, and/or concealing of undesirable bulges of abdominal fat can be achieved. A higher top of the inner-abdominal restraint layer can provide a smoother transition from the restrained abdominal region to the unrestrained regions adjacent to the abdominal region, reducing and/or eliminating the muffin-top effect. In some embodiments, the inner abdominal-restraint layer extends above the front rise of the outer garment layer, over the entire front abdominal region, and up across at least some of the ribs.

When less restraint, smoothing, and/or concealing of undesirable bulges of abdominal fat is necessary, the top of the inner abdominal-restraint layer can be even with the front-rise of the outer garment layer or extend above the front-rise of the outer garment layer by a lesser amount. In embodiments having the inner abdominal-restraint layer even with the front-rise of the outer garment layer or extending above the front-rise of the outer garment layer by a lesser amount, the lower abdominal region can be restrained while smoothing the transition from the restrained lower abdominal region to the unrestrained upper abdominal region. Further, in embodiments having the inner abdominal-restraint layer even with the front-rise of the outer garment layer or extending above the front-rise of the outer garment layer by a lesser amount, a decreased amount of fabric is necessary to make the inner abdominal-restraint layer, potentially leading to material savings and thus cost savings to the manufacturer. Embodiments having less abdominal coverage can also preserve less of a garment-wearer's body heat.

The inner abdominal-restraint layer wraps fully around the garment wearer's body to smooth, restrain, and/or conceal undesirable bulges of abdominal fat on the body. The location of the attachment of the inner abdominal-restraint layer to the outer garment layer can be varied to provide the amount of control, restraint, and or smoothing desired by the garment wearer. The location of the attachment of the inner-abdominal restraint layer to the outer garment layer can be anywhere along the inside of the outer garment layer that would allow for the inner abdominal-restraint layer to control, restrain, or smooth undesirable bulges of abdominal fat, and is not limited to the exemplary embodiments of attaching at the crotch seam, inseam, or yoke of the outer garment layer.

The restraint and control of the garment-wearer's lower abdominal region can be enhanced by attaching the front bottom of the inner abdominal-restraint layer (depicted, for example, in FIG. 3) to the outer garment layer, the back bottom of the inner abdominal-restraint layer (depicted, for example, in FIG. 4) to the outer garment layer, or a combination thereof. The front bottom and/or the back bottom of the inner abdominal-restraint layer can be attached, for instance, to the inner side of the inseam of the outer garment layer, to the inner side of the crotch seam of the outer garment layer, or to a combination thereof. The front bottom and/or the back bottom of the inner abdominal-restraint layer can be attached to any portion of the outer garment layer that would allow for enhanced control or restraint of the garment-wearer's lower abdominal region, and is not limited to the exemplary embodiments of attaching the front bottom to the crotch seam or inseam of the outer garment layer or attaching the back bottom to the yoke of the outer garment layer. Further, the front bottom and/or back bottom of the inner abdominal-restraint layer can be in a variety of shapes. In some embodiments, the front bottom and/or back bottom is flat. In some embodiments, the front bottom and/or back bottom is contoured. In some embodiments, the front bottom and/or back bottom has two leg curves and a flat center portion (i.e., "panty-shaped"). Panty-shaped inner abdominal-restraint layers can, for instance, control and restrain the lower-abdominal region without covering, binding, or cinching the legs. In some embodiments, the inner abdominal-restraint layer is made of one piece of fabric. In some embodiments, the inner abdominal-restraint layer is made of multiple pieces of fabric joined together.

As noted above, the one-piece abdominal-restraint garments disclosed herein conveniently reduce or eliminate the undesirable muffin-top effect to the garment wearer without the need for putting on separate a shape-wear piece (e.g., pantyhose, control-top underwear, etc.) and outer wear piece (e.g., pants, jeans, skirts, leggings, etc.). Additionally, the convenient one-piece abdominal-restraint garment can be easier for the garment wearer to put on and take off than separate shape-wear pieces and outer-wear pieces (for instance, while dressing for the day or during bathroom breaks during the day). The convenient one-piece abdominal-restraint garment can also be a cooler temperature alternative to separate shape-wear pieces and outer-wear pieces, by retaining less body heat of the garment wearer. Further, the inner abdominal-restraint garment can provide comparable control, restraint, and/or smoothing of undesirable abdominal fat as is possible with a separate shape-wear piece, but without causing undesirable riding up or wedgies (i.e., where an undergarment becomes wedged between the garment-wearer's buttocks). Further, the full wrap-around nature of the inner abdominal-restraint layer provides more tummy and/or buttock control than, for instance, an abdominal-restraint garment wherein the inner pockets are attached to the seams. The full wrap-around nature of the inner abdominal-restraint layer can smooth, control, or restrain undesirable bulges of back fat. The embodiments described herein can provide more comfort, muffin-top control, and control to the tummy, back, and/or buttocks than other options available in the prior art. The full wrap-around nature of the inner abdominal-restraint garment can provide enhanced muffin-top control in, for instance, outer garments prone to causing excessive muffin top or binding, such as low-rise jeans. The full wrap-around nature of the inner abdominal-restraint layer can, for instance, provide more control to the fat on the sides and back than an inner abdominal-restraint layer that wraps only partially around the garment-wearer's body. The full wrap-around nature of the inner abdominal-restraint layer can, for instance, provide more control to the fat on the sides, upper abdominals, and back than a pocket bag or full panty sewn into the garment.

Also disclosed herein are methods of assembling abdominal-restraint garments, comprising attaching a front bottom of an inner abdominal-restraint layer to an inner side of an outer garment layer, positioning the inner abdominal-restraint layer over an abdominal portion of the outer garment layer, positioning a front top of the inner abdominal-restraint layer such that it is even with a front rise of the outer garment layer or such that it extends above a front rise of the outer garment layer, and attaching a back bottom of the inner abdominal-restraint layer to the inner side of the outer garment layer.

The garments and methods of the appended claims are not limited in scope by the specific garments and methods described herein, which are intended as illustrations of a few aspects of the claims and any garments and methods that are functionally equivalent are intended to fall within the scope of the claims. Various modifications of the garments and methods in addition to those shown and described herein are intended to fall within the scope of the appended claims. Further, while only certain representative garments and method steps disclosed herein are specifically described, other combinations of the garments and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed.

What is claimed is:

1. An abdominal-restraint garment comprising:

an outer garment layer having a front rise, a back rise, and at least one seam; and an inner abdominal-restraint layer having a front top, a front bottom, a back top, and a back bottom;

wherein only the front bottom and the back bottom of the inner abdominal-restraint layer are attached to an inner side of the outer garment layer on, or adjacent to, the seam of the outer garment;

wherein the front top of the inner abdominal-restraint layer is configured to be even with the front rise of the outer garment layer or extend above the front rise of the outer garment layer, and wherein the back top of the inner abdominal-restraint layer is configured to be even with the back rise of the outer garment layer or extend above the back rise of the outer garment layer.

2. The abdominal-restraint garment of claim 1, wherein the outer garment layer further comprises an inseam and wherein the at least one seam is the inseam.

3. The abdominal-restraint garment of claim 2, wherein the outer garment layer further comprises a yoke with an inner side, and wherein the back bottom of the inner abdominal-restraint layer is attached on or adjacent to the inner side of the yoke.

4. The abdominal-restraint garment of claim 3, wherein the inner abdominal-restraint layer is configured to extend across a garment-wearer's abdominal region.

5. The abdominal-restraint garment of claim 3, wherein the front top of the inner abdominal-restraint layer is configured to extend above the front rise of the outer garment layer by 0.25 inches to 20 inches.

6. The abdominal-restraint garment of claim 3, wherein the back top of the inner abdominal-restraint layer is configured to extend above the back rise of the outer garment layer by 0.25 inches to 20 inches.

7. The abdominal-restraint garment of claim 1, wherein the abdominal-restraint garment is a pair of pants, jeans, a pair of shorts, a skirt, leggings, or tights.

8. The abdominal-restraint garment of claim 1, wherein the outer garment layer comprises denim, twill, woven fabric, or knit fabric.

9. The abdominal-restraint garment of claim 1, wherein the inner abdominal-restraint layer comprises spandex.

10. The abdominal-restraint garment of claim 1, wherein the inner abdominal-restraint layer comprises a double-layer of fabric with elastic stitched between the two layers.

11. The abdominal-restraint garment of claim 1, wherein the inner abdominal-restraint layer comprises a single layer of fabric.

12. The abdominal-restraint garment of claim 11, wherein the inner abdominal-restraint layer does not comprise elastic.

13. The abdominal-restraint garment of claim 1, wherein the inner abdominal-restraint layer is attached to the outer garment layer using one of a group consisting of sewing, adhering, zipping, buttoning, snapping, heat sealing, welding, gluing, bonding, laser cutting, and combinations thereof.

14. The abdominal-restraint garment of claim 1, wherein the inner abdominal-restraint layer has a higher elasticity than the outer garment layer.

15. A method of assembling an abdominal-restraint garment, the method comprising attaching a front portion of an inner abdominal-restraint layer to an inner side of an anterior portion of an outer garment layer on or adjacent to a seam of the outer garment layer and only at the front bottom of the inner abdominal-restraint layer;

positioning the inner abdominal-restraint layer over an abdominal portion of the outer garment layer;

positioning a front top of the inner abdominal-restraint layer such that the front top is even with a front rise of the outer garment layer or such that the front top extends above a front rise of the outer garment layer;

positioning a back top of the inner abdominal-restraint layer such that it is even with a back rise of the outer garment layer or such that it extends above a back rise of the outer garment layer.

16. The method of claim 15, further comprising attaching the front bottom of the inner abdominal-restraint layer on or adjacent to an inner side of an inseam of the outer garment layer.

17. The method of claim 15, further comprising attaching the front bottom of the inner abdominal-restraint layer on or adjacent to an inner side of a crotch seam of the outer garment layer.

18. The method of claim 15, further comprising attaching the back bottom of the inner abdominal-restraint layer on or adjacent to a yoke of the outer garment layer.

19. The method of claim 15, wherein attaching includes at least one of sewing, adhering, zipping, buttoning, snapping, heat sealing, welding, gluing, bonding, laser cutting, or combinations thereof.

20. The method of claim 15, wherein attaching comprises configuring the inner abdominal-restraint layer to extend above the front rise of the outer garment layer by 0.25 inches to 20 inches.

21. The method of claim 15, wherein attaching comprises configuring the inner abdominal-restraint layer to extend above the back rise of the outer garment layer by 0.25 inches to 20 inches.

22. The method of claim 15, wherein the outer garment layer comprises denim, twill, woven fabric, or knit fabric.

23. The method of claim 15, wherein the inner abdominal-restraint layer comprises spandex.

24. The method of claim 15, wherein the inner abdominal-restraint layer comprises a double-layer of fabric with elastic stitched between the two layers.

25. The method of claim 15, wherein the inner abdominal-restraint layer comprises a single layer of fabric.

26. The method of claim 25, wherein the inner abdominal-restraint layer does not comprise elastic.

27. The abdominal-restraint garment of claim 1, wherein the outer garment layer further comprises a crotch seam, and wherein the at least one seam is the crotch seam.

28. The method of claim 15, further comprising attaching a back portion of the inner abdominal-restraint layer to an inner side of a posterior portion of the outer garment layer on or adjacent to a seam of the outer garment layer and only at a back bottom of the inner abdominal-restraint layer.

29. An abdominal-restraint garment comprising:

an outer garment layer having a back rise and a yoke seam; and an inner abdominal-restraint layer having at least one back bottom portion and one back top portion;

wherein the inner abdominal-restraint layer is attached along the bottom portion and on, or adjacent to, the yoke seam of the outer garment layer;

wherein the inner abdominal-restraint layer extends freely up from the bottom portion to the top portion until even with or above the rise.

* * * * *